United States Patent [19]

Inoue

[11] 4,233,777

[45] Nov. 18, 1980

[54] FLOATING DOLL, TOY ASSEMBLY

[75] Inventor: Tsutomu Inoue, Ichikawa, Japan

[73] Assignee: Takara Co., Ltd., Tokyo, Japan

[21] Appl. No.: 10,532

[22] Filed: Feb. 9, 1979

[51] Int. Cl.[3] ..... A63H 33/26

[52] U.S. Cl. ..... 46/238; 46/11; 46/25; 46/32; 46/202; 40/426

[58] Field of Search ..... 46/236, 237, 238, 239, 46/25; 40/426

[56] References Cited

U.S. PATENT DOCUMENTS

| | | | |
|---|---|---|---|
| 1,330,780 | 2/1920 | Bonte | 46/25 UX |
| 2,323,837 | 7/1943 | Neal | 46/238 X |
| 3,965,613 | 6/1976 | Saunders | 46/238 X |
| 4,103,774 | 8/1978 | Shingyouchi | 46/25 X |
| 4,118,888 | 10/1978 | Ogawa | 46/22 |

FOREIGN PATENT DOCUMENTS

| | | | |
|---|---|---|---|
| 1382865 | 11/1964 | France | 46/238 |
| 574516 | 3/1958 | Italy | 40/426 |

*Primary Examiner*—F. Barry Shay

*Attorney, Agent, or Firm*—Jackson, Jones & Price

[57] ABSTRACT

A toy assembly capable of maintaining a toy figure in a floating position within a transparent container, is disclosed. A base member attached to the container includes a first permanent magnet. A floating base member dimensioned to be slideably contained within the container includes a second permanent magnet. The toy figure is removably mounted on the floating base member. The first and second magnets are disposed to repel each other thereby causing the toy figure to float within the container. A plurality of toy appendages are provided. These include a carriage member upon which the floating base member may be mounted together with the toy figure. The first permanent magnet may be used to propel the assembly of the carriage member, the floating base member and the toy figure on a support surface.

17 Claims, 5 Drawing Figures

FLOATING DOLL, TOY ASSEMBLY

BACKGROUND OF THE INVENTION

1. Field of the Invention

The present invention relates to a toy assembly, and more particularly to a toy assembly having a magnetically floated doll in a transparent container member.

2. Brief Description of the Prior Art

The prior art has provided several toy devices which utilize magnetic forces for mounting various component parts of the toy to one another. An example of a toy doll having magnetically connected joints is found in U.S. Pat. No. 4,118,888.

The toy industry is continuously striving to design toys having features which appeal to the creative imagination of the children playing with the toys. However, the toy industry has not provided a toy assembly having the multitude of features of the novel toy assembly of the present invention including a toy figure held in a floating position by magnetic forces and subsequently movable by the same magnetic forces.

SUMMARY OF THE INVENTION

It is an object of the present invention to provide a toy assembly wherein a toy figure is maintained in a floating position within a transparent container.

It is another object of the present invention to provide a toy assembly wherein a container for a magnetically floated toy figure can also be utilized to magnetically propel the toy figure upon a support surface.

These and other objects and advantages are attained by a toy assembly having a transparent container and a base member mounted thereto. A floating base member is placed into the container wherein its movement in all directions other than in a vertical direction is substantially prevented by a plurality of walls of the container. A toy figure is removably mounted upon the floating base member. A first permanent magnet and a second permanent magnet is incorporated respectively in the base member and in the floating base member. The first and second magnets are disposed in such a manner that when the floating base member is placed into the container the first and second magnets repel each other. As a result, the toy figure floats in the container.

A carriage member is provided upon which the floating base member and the toy figure may be mounted. The container having the base member may be used to magnetically propel the toy figure mounted to the carriage member.

The objects and features of the present invention are set forth with particularity in the appended claims. The present invention may be best understood by reference to the following description, taken in connection with the accompanying drawings in which like numerals indicate like parts.

DESCRIPTION OF THE PREFERRED EMBODIMENT

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventor for carrying out his invention in a commercial environment, although it should be understood that various modifications may be accomplished within the parameters of the present invention.

Figure 1:
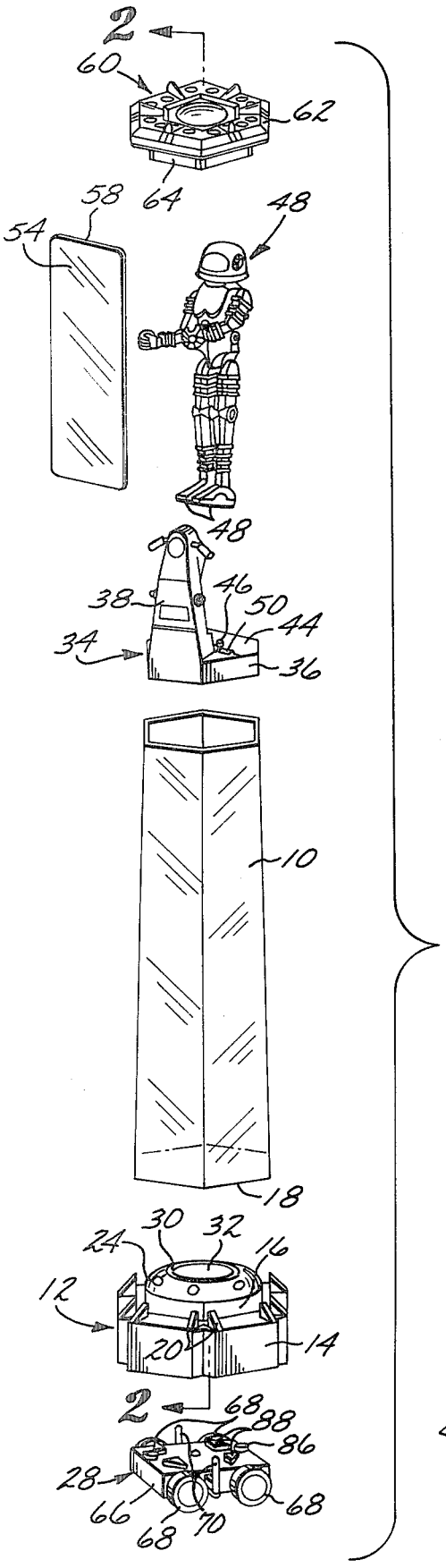
FIG. 1 is an exploded perspective view of a specific embodiment of the toy assembly of the present invention.

Referring to the exploded perspective view of FIG. 1 a specific embodiment of the toy assembly of the present invention is disclosed. An elongated container 10 integrally constructed from suitable transparent plastic material is mounted to a base member 12. The general shape of the container 10 resembles a post or column which is slightly tapered in an upwardly direction. The container 10 has a hexagonal cross section taken in a plane perpendicular to its general longitudinal axis.

The base member 12 has a polygonal lower portion 14, and a hexagonal intermediate portion 16. The latter is dimensioned to be inserted and friction fitted within a lower end 18 of the container 10. A plurality of protrusions or studs 20 are placed on an outer periphery of the lower portion 14 of the base member 12. The protrusions or studs 20 are dimensioned to tightly embrace an outer wall 22 of the container 10. As a result the base member is securely and yet removably attached to the container 10.

The base member 12 also has a substantially round top portion 24 which is dimensioned to be fully contained within the container 10. The lower portion 14 of the base member 12 contains a cavity 26, shown on FIGS. 2 and 5, which is large enough to accomodate a carriage member 28. The carriage member is shown on FIGS. 1, 4 and 5 and is described in detail below.

The round top portion 24 of the base member 12 includes a circular hole or aperture 30 having a disc shaped first permanent magnet 32 mounted therein. The mounting of the first permanent magnet 32 within the circular aperture 30 may be accomplished by simply gluing the first permanent magnet to a bottom wall (not shown) of the aperture 30.

A floating base member 34 having a hexagonally shaped lower portion 36 and a substantially vertically disposed upper portion 38, is placed in the container 10. The lower portion 36 is dimensioned to slideably fit within the slightly tapered container 10 in such a manner that it is substantially prevented therein from moving in any direction other than in a vertical direction.

Figure 2:
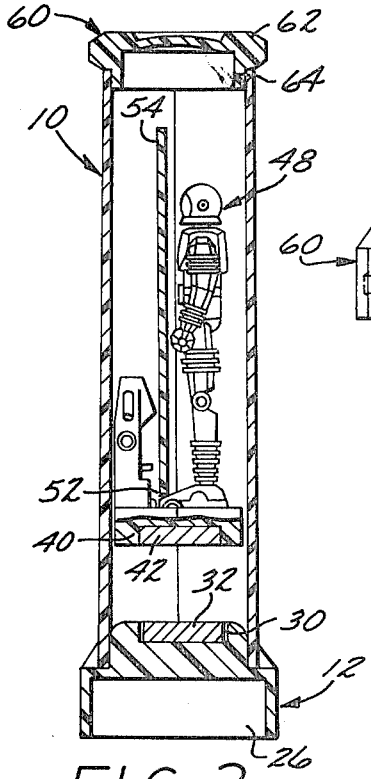
FIG. 2 is a cross sectional view of the specific embodiment of the present invvention, the cross section being taken at line 2—2 of FIG. 1.

The lower portion 36 of the floating base member 34 includes a circular hole or aperture 40, shown on FIG. 2. A second disc shaped permanent magnet 42 is mounted into the aperture 40. As illustrated on FIG. 2, the first, 32, and second, 42, disc shaped permanent magnets are in substantially parallel disposition. The permanent magnets 32 and 42 have their respective magnetic poles of the same polarity facing each other whereby the two magnets 32 and 42 repel each other. For example, an upper half of the permanent magnet 32 is of one polarity and a lower half of the permanent magnet 42 is also of the same polarity, so that in their above described parallel disposition the magnet forces of the two magnets 32 and 42 repel each other.

Figure 4:
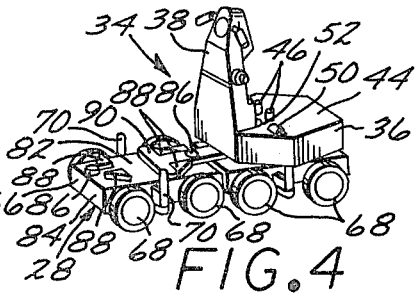
FIG. 4 is a perspective view of two carriage members of the present invention connected to one another, a floating base member being mounted upon one of the carriage members.

The upper, substantially vertically disposed portion 38 of the floating base member 34 is configured to simulate a control or instrument column of a space vehicle. An upper surface 44 of the lower portion 36 of the floating base member 34 contains a pair of cylindrically shaped, spaced-apart protrusions or studs 46 best shown in FIG. 4. The studs 46 are provided to allow for the attachment of a doll figure 48 to the floating base member 34. In addition to the studs 46, the upper surface 44 includes a second pair of cylindrical protrusions 50, one of which is shown in FIGS. 1, 2 and 4. The second pair of cylindrical protrusions 50 and the base of the upper portion 38 of the floating base member 34 form a channel 52 upon the upper surface 44. As it is discussed below, the channel 52 receives a transparent plastic panel member 54 which assists the doll figure 48 to stay in an upright position.

The doll figure 48 of the specific embodiment described here, has the general appearance of a warrior or space traveller and has articulated, movable joints. It should be however readily apparent to those skilled in the art, that various toy figures other than a toy doll simulating a human figure may be used in the present invention. Accordingly, other floating toy figures such as floating animals and the like are intended to be within the scope of the present invention.

The doll figure 48 has an aperture (not shown) incorporated in the sole of each shoe 56 of the doll figure 48. The doll figure 48 is friction fitted upon the studs 46 through the apertures (not shown) and thereby is removably attached to the floating base member 34.

The transparent panel member 54 comprises an elongated rectangle. As shown on FIGS. 1 and 2, it is dimensioned to be inserted in the channel 52. A shorter side 58 of the panel member 54 substantially corresponds to the inner diameter of the narrowest portion of the tapered container 10. Consequently, the panel member 54 when placed in position in the channel 52 prevents the floating base member 34 and the doll 48 mounted thereto from undergoing rotation in the container 10 about a vertical axis. The panel member 54 also assists the doll 48 to stay in a substantially upright position in the container 10. A top closure member 60 shown in FIGS. 1 and 2, is provided to close the upper opening in the container 10. The top closure member 60 has a hexagonal upper portion 62 and a smaller hexagonal lower portion 64 which is friction fitted into the container 10.

The weights of the floating base member 34, the doll 48 and of the transparent panel member 54 are selected in such a manner that they are counterbalanced by the repelling magnetic forces when the second permanent magnet 42 is located at approximately $\frac{1}{2}$–$\frac{5}{8}$ inches from the first permanent magnet 32. Consequently, the doll 48 appears to float within the container without a physical support readily perceivable by a child. Both magnets 32 and 42 may be hidden from view by the simple expediency of a paper sticker (not shown) glued to the top peripheries thereof. This further enhances the puzzling, futuristic effect of the toy assembly of the present invention. The entire toy assembly is configured to create the image of a space capsule with a human space traveller floatingly contained therein.

In order to enable a child user to exercise further play options, the carriage member 28 is provided. The carriage member 28, shown on FIGS. 1, 4 and 5, comprises a substantially rectangular base 66 which has 4 wheels 68 rotatably mounted thereto. A pair of prongs or studs 70 extend upwardly in a vertical direction from the base 66. The prongs or studs 70 may be friction fitted in a pair of matchingly spaced apertures 71, shown in FIG. 5, in a bottom surface 72 of the base member 12. Thus, when not in use the carriage member 28 may be stored in the cavity 26 contained in the base member 12.

Figure 5:
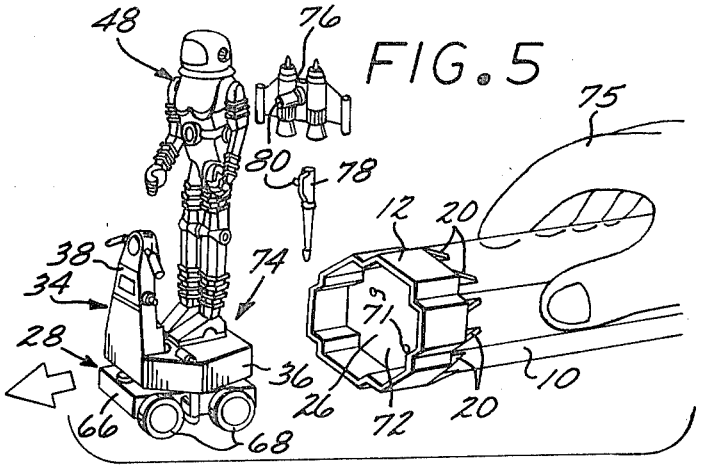
FIG. 5 is a perspective view of a toy doll and of the floating base member of the present invention mounted to the carriage member, and propelled by a magnet mounted to a container member.

FIG. 5 discloses a play option wherein the carriage member 28 is attached to the floating base member 14. This attachment is accomplished by mounting the prongs or studs 70 into a pair of matchingly spaced apertures (not shown) on the bottom of the floating base member 34. The doll figure 48, in turn, is mounted upon the floating base member 34. In this position the doll figure 48 simulates a driver of a land going vehicle 74 which has a futuristic control or steering column.

In addition to being able to manually move the land going vehicle 74, a child may also utilize the first 32 and second magnets for propelling the land going vehicle 74. As it was described above, the first 32 and second 42 magnets are respectively incorporated in the base member 12 and in the floating base member 34. In order to magnetically drive the land going vehicle 74 when base 34 is mounted thereon a child user of the present invention holds the container 10 with the base member 12 mounted thereto in a substantially horizontal position, as shown on FIG. 5. A hand shown holding the container 10 bears the reference numeral 75. The height of the carriage member 28 and the dimensions of the magnets 32 and 42 are designed in such a manner that as the base member 12 approaches the land going vehicle 74, the magnets 32 and 42 repel each other. This is because as is stated above for the specific example disclosed here, the lower half of the permanent magnet 42 may be of Northern polarity in which case the upper half of the magnet 42 is necessarily of Southern polarity. In the arrangement illustrated in FIG. 5 the permanent magnet 42 incorporated in the floating base member 34 has its Northern pole facing downward and its Southern pole upward. The permanent magnet 32 incorporated in the base member 12 has its Southern pole facing outward, i.e. towards the floating base member 34. Because the height of the carriage member 28 is properly selected, when the base member 12 approaches the land going vehicle 12 over a support surface the Southern pole of the magnet 32 is substantially aligned with the Southern pole of magnet 42. Accordingly, a repelling rather than an attracting force arises between the two magnets 32 and 42. Consequently, the land going vehicle 74 is, in effect, caused to roll forward without being touched by any physical object. The direction of forward movement of the land going vehicle 74 is indicated by an arrow on FIG. 5. The ability of the land going vehicle 74 to move forward without actual contact with a physical object further enhances the futuristic, science-fiction-type image created by the toy assembly of the present invention.

A plurality of small toy appendages such as a simulated rocket pack 76, and a toy dagger 78 are provided. As shown on FIG. 5, the rocket pack 76 and the dagger 78 may be assembled respectively to the back and to the hip of the doll figure 48. A stud 80 protruding from each of the toy appendages 76 and 78 is received in matching apertures (not shown) located respectively on the back and on the hip of the doll figure 48.

Referring now to the perspective view of FIG. 4, still another play option provided by the toy assembly of the present invention is disclosed. The base 66 of the carriage member 28 has on its upper surface 82 adjacent to each shorter side 84 thereof, a group of protrusions. Each group includes a cylindrical stud 86 and a pair of triangles 88 elevated from the upper surface 82. A connecting member 90 having a T shaped portion shown on FIG. 4, is laid upon the upper surface 82. There it is prevented from a lateral dislocation by the stud 86 and the triangles 88. The stud 86 engages an aperture in the body of the connecting member 90. The connecting member 90 is symmetrical in shape, i.e. a second portion of the connecting member 90 not discernible on FIG. 4, is identical to the T shaped first portion.

FIG. 4 discloses how two carriage members 28 are assembled with the assistance of the connecting member 90. The connecting member is fastened to both carriage members 28 in the manner described above. It is apparent that more than 2 carriage members 28 may be interconnected. Furthermore a plurality of floating base members 34 and a plurality of doll figures 48 may be provided, each of which may be mounted to the interconnected carriage members 28. In the specific embodiment depicted in FIG. 4 a floating base member 34 is mounted upon one of the interconnected carriage members 28.

Figure 3:
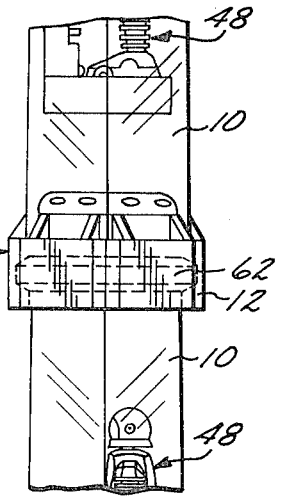
FIG. 3 is a partial side view of two toy assemblies each comprising the specific embodiment of the present invention, the two toy assemblies being mounted to one another.

Reference is now made to the side view of FIG. 3 wherein two toy assemblies mounted or stacked one upon another, are disclosed. Each toy assembly contains the floating doll figure 48. The mounting or stacking is accomplished by utilizing the hexagonal upper portion 62 of the top closure member 60 which is dimensioned to tightly fit within the cavity 26 contained in the base member 12. Thus, a first toy assembly may be attached through its base member 12 to the top closure member 60 of a second assembly. In this manner a plurality of toy assemblies may be mounted on top of one another thereby providing yet another play option for a child user of the present invention.

What has been described above is a versatile toy assembly having a magnetically floating toy figure contained in a transparent container. It will be apparent to those skilled in the art that various modifications of the present invention are possible. A particularly apparent modification is to change the shape of the container 10 from one having a hexagonal cross section to one having other polygonal or curved cross sections. In such a case the shape of the base member 12 and of the floating base member must be similarly modified. Accordingly the scope of the present invention should be interpreted solely from the following claims.

What is claimed is:

1. A toy assembly comprising:

a container;

a base member mounted to the container and including a first permanent magnet;

a floating base member contained in the container;

a toy figure contained in the container and mounted to the floating base member, the floating base member including a second permanent magnet, the first and second permanent magnets being disposed to repel one another whereby the toy figure is suspended in the container to simulate a floating effect, and a transparent panel member removably mounted to the floating base member, the panel member being dimensioned to prevent rotation of the toy figure within the container.

2. The invention of claim 1 further comprising a carriage member to which the floating base member attached to the toy figure is mounted when removed from the container; and wherein the assembled container and the base member on the one hand and the assembled carriage member, toy figure and floating base member on the other hand, comprise magnetic means for propelling the assembly of the carriage member, floating base member and of the toy figure.

3. The invention of claim 2 wherein the base member contains a cavity, and the carriage member is removably mounted within the cavity.

4. The invention of claim 1 wherein the container is transparent.

5. The invention of claim 1 further comprising a top closure member to close the container.

6. The invention of claim 5 wherein the top closure member includes means for mounting a second toy assembly identical with the toy assembly of claim 5 on top thereof, whereby the two toy assemblies may be stacked.

7. A toy assembly comprising:

a transparent container;

a base member including a first permanent magnet, the base member being mounted to the container;

a floating base member including a second permanent magnet, the floating base member being dimensioned to move in a vertical direction within the container and prevented from substantial movement in a horizontal direction within the container, the first and second magnets being disposed to repel each other whereby the floating base member is contained in an intermediary portion of the container without being in a physical contact with the base member;

a toy figure removably mounted to the floating base member, and a carriage member removably mountable to the base member, the carriage member capable of removably mounting the floating base member, when the latter is removed from the container, the first permanent magnet and the second permanent magnet when the base member is mounted to the container and when the floating base member is mounted to the carriage member comprising means for magnetically propelling the carriage member over a support surface.

8. The invention of claim 7 wherein the container is tapered in an upward direction.

9. The invention of claim 7 wherein the container has a hexagonal cross section.

10. The invention of claim 7 wherein the base member has a cavity wherein the carriage member may be mounted.

11. The invention of claim 7 wherein the toy figure is an articulated toy doll.

12. The invention of claim 7 further comprising a top closure member removably attachable to the container.

13. The invention of claim 12 comprising at least a first and a second toy assembly, each toy assembly having the base member and the top closure member, the base member and the top closure member having a mechanical means for mounting the base member of the first toy assembly to the top closure member of the second toy assembly whereby the first and second toy assemblies are stacked.

14. The invention of claim 7 further comprising at least one toy appendage attachable to the toy figure.

15. The invention of claim 14 wherein the toy appendage is a simulated rocket pack.

16. The invention of claim 14 wherein the toy appendage is a toy weapon.

17. The invention of claim 7 wherein the toy assembly further comprises a transparent panel member removably mounted to the floating base member, the panel member being dimensioned to assist the toy figure to stay in a substantially upright position within the container.

* * * * *

UNITED STATES PATENT AND TRADEMARK OFFICE

CERTIFICATE OF CORRECTION

PATENT NO. : 4,233,777

DATED : November 18, 1980

INVENTOR(S) : Tsutomu Inoue

It is certified that error appears in the above—identified patent and that said Letters Patent is hereby corrected as shown below:

Column 1, line 65, delete "invvention" and insert --invention--.

Column 4, line 17, delete "14" and insert --34--.

Signed and Sealed this

*Seventh* Day of *April 1981*

[SEAL]

*Attest:*

RENE D. TEGTMEYER

*Attesting Officer* *Acting Commissioner of Patents and Trademarks*